US010355388B2

(12) United States Patent
Takahashi

(10) Patent No.: US 10,355,388 B2
(45) Date of Patent: Jul. 16, 2019

(54) CONNECTOR

(71) Applicant: Sumitomo Wiring Systems, Ltd., Yokkaichi, Mie (JP)

(72) Inventor: Kenya Takahashi, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/088,559

(22) PCT Filed: Mar. 22, 2017

(86) PCT No.: PCT/JP2017/011365
§ 371 (c)(1),
(2) Date: Sep. 26, 2018

(87) PCT Pub. No.: WO2017/179376
PCT Pub. Date: Oct. 19, 2017

(65) Prior Publication Data

US 2019/0109400 A1 Apr. 11, 2019

(30) Foreign Application Priority Data

Apr. 12, 2016 (JP) ..... 2016-079474

(51) Int. Cl.
*H01R 13/52* (2006.01)
*H01R 13/436* (2006.01)

(52) U.S. Cl.
CPC ..... *H01R 13/4367* (2013.01); *H01R 13/5202* (2013.01)

(58) Field of Classification Search
CPC ..... H01R 13/4367; H01R 13/5202
See application file for complete search history.

(56) References Cited

U.S. PATENT DOCUMENTS 5,779,493 A 7/1998 Tomita et al.
7,156,698 B2 * 1/2007 Yamashita ..... H01R 13/5208 439/587

(Continued)

FOREIGN PATENT DOCUMENTS

JP 9-129303 5/1997
JP 2006-156081 6/2006

(Continued)

OTHER PUBLICATIONS

International Search Report dated Jun. 20, 2017.

*Primary Examiner* — Briggitte R. Hammond
(74) *Attorney, Agent, or Firm* — Gerald E. Hespos; Michael J. Porco; Matthew T. Hespos

(57) ABSTRACT

A connector includes a housing (20) with a terminal accommodation chamber (30). A retainer (50) covers a rear opening (40A) of the housing (20), and a fitting tube (53) on a front surface of the retainer (50) is fit into the rear opening (40A) of the housing (20). A seal ring (70) is mounted on an outer peripheral surface of the fitting tube (53) and is compressed between the outer peripheral surface of the fitting tube (53) and an inner peripheral surface of the rear surface opening (40A). A retaining portion (75) having a locking head (76) on a tip projects on a rear surface of the seal ring (70). A locking hole (62) is provided in a periphery of the retainer (50), the retaining portion (75) being passable through the locking hole, and the locking head (76) is locked to an edge of the locking hole (62) from behind.

6 Claims, 16 Drawing Sheets

(56) References Cited

U.S. PATENT DOCUMENTS

| | | | | |
|---|---|---|---|---|
| 8,545,264 | B2 * | 10/2013 | Nawa | H01R 13/5208<br>439/274 |
| 8,771,014 | B2 * | 7/2014 | Nakamura | H01R 13/5208<br>439/587 |
| 2002/0173205 | A1 * | 11/2002 | Kato | H01R 13/4367<br>439/752 |
| 2003/0087551 | A1 * | 5/2003 | Okayasu | H01R 13/4368<br>439/587 |
| 2011/0034053 | A1 * | 2/2011 | Matsumoto | B60L 3/0069<br>439/304 |
| 2015/0244103 | A1 * | 8/2015 | Kashiwada | H01R 13/5213<br>439/272 |

FOREIGN PATENT DOCUMENTS

| | | |
|---|---|---|
| JP | 2010-80106 | 4/2010 |
| JP | 2011-24903 | 2/2011 |
| JP | 2014-135194 | 7/2014 |
| JP | 2014-229420 | 12/2014 |
| JP | 2016-35804 | 3/2016 |

* cited by examiner

CONNECTOR

BACKGROUND

Field of the Invention

This specification relates to a waterproof structure in a connector, such as a vehicle-side connector applied for charging.

Related Art

Japanese Unexamined Patent Publication No. 2011-24903 discloses a vehicle-side connector to be connected to a charging connector during charging. This connector includes a terminal fitting having a wire connecting portion connected to an end of a wire, a housing provided with a terminal accommodation chamber into which the terminal fitting is to be inserted from behind, and a retainer to retain the terminal fitting by being mounted to cover a rear opening of the housing.

The vehicle-side connector of this type requires waterproofing measures to be taken for a part of the housing where the retainer is mounted. A relatively simple waterproof structure provides a fitting tube on the front surface of the retainer. The fitting tube can fit into the rear opening of the housing with a clearance. A seal ring is mounted on the outer peripheral surface of the fitting tube and is compressed resiliently between the outer peripheral surface of the fitting tube and the inner peripheral surface of the rear opening.

The waterproof structure described above requires the seal ring to be transported to a connector assembling site or the like while being fit on the fitting tube of the retainer in advance. The seal ring is held only by frictional engagement and may be displaced due to vibration during transportation or the like. If the retainer is mounted into the housing with a positional deviation of the seal ring overlooked, appropriate sealing performance cannot be expected in some cases. Particularly, a small positional deviation is difficult to confirm visually. Thus, there has been a problem that an inspection process for inspecting the presence or absence of leakage has to be performed after the mounting of the retainer.

The invention was completed on the basis of the above situation and aims to enable a seal ring to be held firmly at a proper position and to enable easy visual discrimination as to whether or not a holding state is appropriate.

SUMMARY

The invention is directed to a connector with a housing provided with a terminal accommodation chamber and a retainer to be mounted while covering a rear opening of the housing. A fitting tube is provided on a front surface of the retainer and can fit into the rear opening of the housing with a clearance. A seal ring is mounted on an outer peripheral surface of the fitting tube and is compressed resiliently between the outer peripheral surface of the fitting tube and an inner peripheral surface of the rear opening. A retaining portion projects on a rear surface of the seal ring and has a locking head on a tip. A locking hole is provided in a peripheral part of the retainer, and the retaining portion is passable through the locking hole. The locking head is locked to an edge of the locking hole from behind.

The seal ring is fit on the outer peripheral surface of the fitting tube of the retainer while the locking head of the retaining portion is pushed into the locking hole. When the seal ring is fit by a proper amount, the locking head of the retaining portion passes through the locking hole and is locked to the edge of the locking hole from behind so that the seal ring is retained and mounted at a proper position on the outer peripheral surface of the fitting tube. When the retainer is fit into the rear surface opening of the housing with the seal ring mounted in advance in this way, the seal ring is compressed resiliently between and held in close contact with the outer peripheral surface of the fitting tube and the inner peripheral surface of the rear surface opening to provide sealing between the retainer and the housing.

Retaining the seal ring prevents a positional deviation of the seal ring during transportation and the like. Thus, a reliable sealing function can be obtained when the retainer is mounted into the housing. Further, proper mounting of the seal ring is assured by visually confirming that the locking head of the retaining portion has passed to the back side of the locking hole and, consequently, it can ensured that a proper sealing function is exhibited when the retainer is mounted. Thus, a large-scale inspection process for inspecting the presence or absence of leakage need not be performed, and a connector assembling process can be simplified.

The retaining portion may be a plate and the locking head may protrude laterally from both side edges of the retaining portion.

A rear edge of the locking head may be at a right angle to an axis line to enhance a retaining force by the retaining portion. However, the locking head needs to be removed forcibly from a mold hole of a mold. Thus, there is a limit in making an angle of the rear edge of the locking head closer to a right angle.

Accordingly, the retaining portion is plate-shaped such that the locking head protrudes laterally from both side edges of the retaining portion. Thus, even if the rear edge of the locking head is formed to be at a right angle to the axis line, the retaining portion can be removed forcibly by suppressing an area of engagement with an edge of the mold hole. As a result, a high retaining force can be obtained.

A lip is formed over an entire circumference on an outer peripheral surface of the seal ring and is held in close contact with the inner peripheral surface of the rear opening of the housing. A cut groove is formed over the entire circumference at a position corresponding to an inner side of the lip on an inner peripheral surface of the seal ring.

By forming the cut groove at the position corresponding to the inner side of the lip on the inner peripheral surface of the seal ring, a thickness of the seal ring is substantially constant in an axial direction. The seal ring is mounted slidingly on the outer peripheral surface of the fitting tube while receiving frictional resistance. However, since the thickness of the seal ring is substantially constant as described above, the seal ring will not buckle during mounting and, consequently, the seal ring can be mounted more smoothly.

The locking head of the retaining portion may have a tapered shape. Thus, the locking head of the retaining portion is pushed easily into the locking hole and, consequently, the seal ring is mounted easily.

According to this specification, the seal ring can be held firmly at the proper position and whether or not a holding state is appropriate easily can be confirmed visually.

DETAILED DESCRIPTION

An embodiment applied to a vehicle-side connector is described with reference to FIGS. 1 to 19. A vehicle-side connector VC of this embodiment is connected to a battery (not shown) mounted in an electric vehicle, a hybrid vehicle or the like and fit and connected to a charging connector (not shown) when charging this battery. The vehicle-side connector VC is a five-pole connector and includes, as shown in FIGS. 1 to 4, an inlet housing 20 (hereinafter, housing 20) accommodating unillustrated terminal fittings and to be mounted on a body of the vehicle, and a retainer 50 to be mounted on a rear surface side of the housing 20 to retain the terminal fittings.

Although not shown, the terminal fittings include two power terminals, one ground terminal and two signal terminals, and have a similar basic structure although diameters and the like may be different depending on types. The terminal fittings are described below, taking the ground terminal as an example.

The terminal fitting is formed as a forging in the form of a round bar, and a terminal connecting portion having a small diameter, a flange and a wire connecting portion having a large diameter are successively provided from the front.

A tip of the terminal connecting portion is connectable to a mating charging terminal (not shown) and a cap (not shown) made of an insulating material is fit to a tip of the terminal connecting portion.

A rearwardly open crimping hole (not shown) is formed in a rear end of the wire connecting portion. An end processing is applied to the unillustrated wire to remove (strip) an end of an insulation coating over a predetermined length, and an end of an exposed core is inserted into the crimping hole and crimped so that the end of the wire is connected electrically to the wire connecting portion of the terminal fitting.

Figure 1:
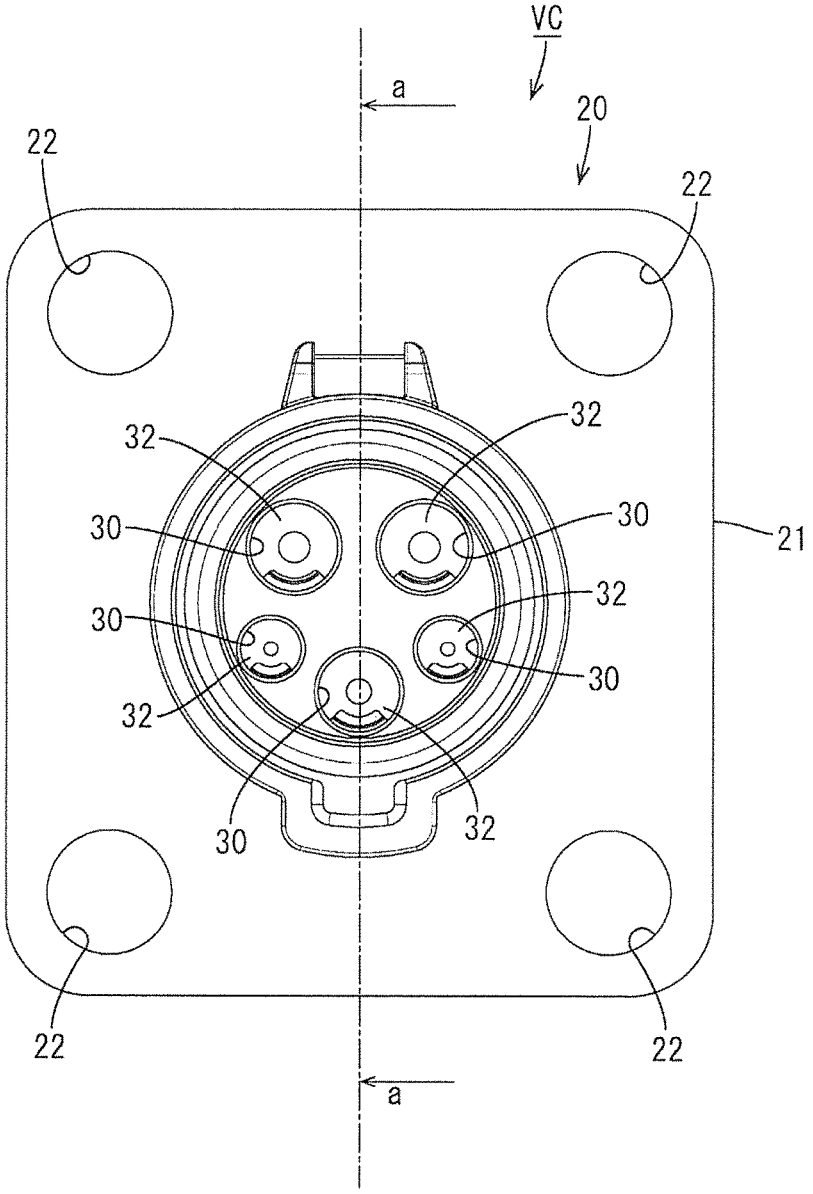
FIG. 1 is a front view of a vehicle-side connector according to an embodiment.
Figure 4:
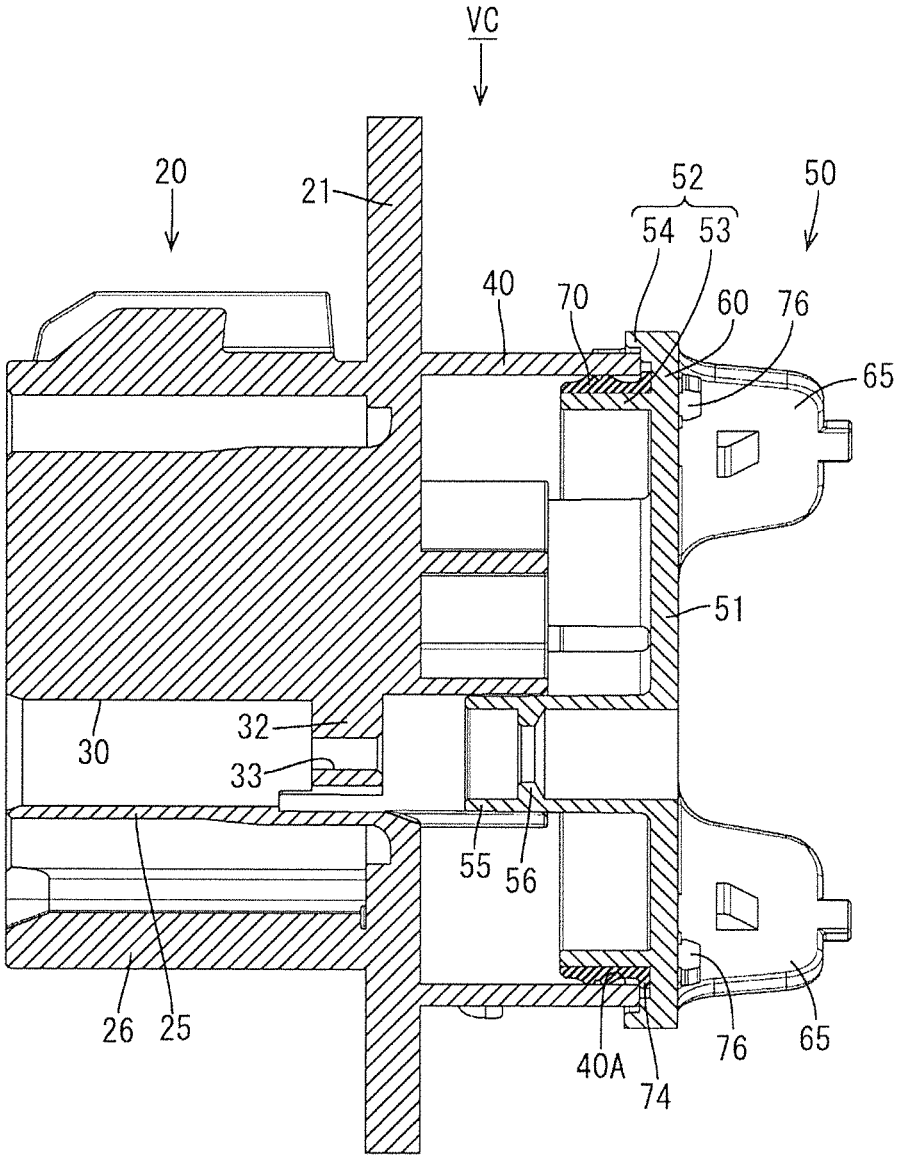
FIG. 4 is a section along a-a of FIG. 1.

The housing 20 is made of synthetic resin and, as shown in FIGS. 1 and 4, includes a mounting plate 21 to be fixed to a panel of the body of the vehicle. A terminal accommodating portion 25 projects from the mounting plate and has terminal accommodation chambers 30 penetrating through the mounting plate 21 in a front-rear direction for accommodating the terminal fittings. A peripheral wall 40 projects from the back surface of the mounting plate 21 to surround the outer periphery of the terminal accommodating portion 25.

The mounting plate 21 is formed into a rectangular shape and mounting holes 22 are open on four corners.

A receptacle 26 is formed on the outer periphery of the terminal accommodating portion 25 and the terminal accommodating portion 25 and the receptacle 26 are formed integrally so that the receptacle 26 and a front end of the terminal accommodating portion 25 project a predetermined distance from the front surface of the mounting plate 21.

The terminal accommodating portion 25 has five terminal accommodation chambers 30 in an arrangement shown in FIG. 1. The terminal accommodation chambers 30 have a similar basic structure although lengths and the like are different depending on the types of the terminal fittings to be accommodated. FIG. 4 shows the terminal accommodation chamber 30 for accommodating the ground terminal.

The terminal accommodation chamber 30 is a substantially round hole open in both front and rear surfaces, and a front end thereof in front of an intermediate wall 32 serves as a front accommodation chamber while a rear end thereof serves as a rear accommodation chamber. A terminal insertion hole 33 penetrates through a center of the intermediate wall 32.

The terminal fitting is inserted into the rear accommodation chamber of the terminal accommodation chamber 30 from behind. After the terminal connecting portion is pushed through the terminal insertion hole 33, the flange contacts the rear surface of the intermediate wall 32 to stop the insertion. At this time, a tip part of the terminal connecting portion projects into the front accommodation chamber and a part of the terminal fitting from the flange to a position near the rear end of the wire connecting portion is accommodated in the rear accommodation chamber.

The retainer 50 made of synthetic resin and is mounted on the rear of the housing 20 to retain each terminal fitting. Specifically, the rearwardly open tubular peripheral wall 40 is formed on the rear of the terminal accommodating portion 25 to surround an area behind a rear end part of the terminal accommodating portion. The retainer 50 is mounted into a rear surface opening 40A of this peripheral wall 40.

As shown in FIGS. 7 to 11, the retainer 50 is such that a cap-shaped double tube portion 52 composed of an inner tube 53 and an outer tube 54 projects on the outer peripheral edge of the front surface of a circular base plate 51. As shown in FIG. 4, the inner tube 53 of the double tube portion 52 is fit inside a rear end part of the peripheral wall 40 with a clearance, whereas the outer tube 54 is substantially tightly fit outside the rear end part of the peripheral wall 40.

Figure 11:
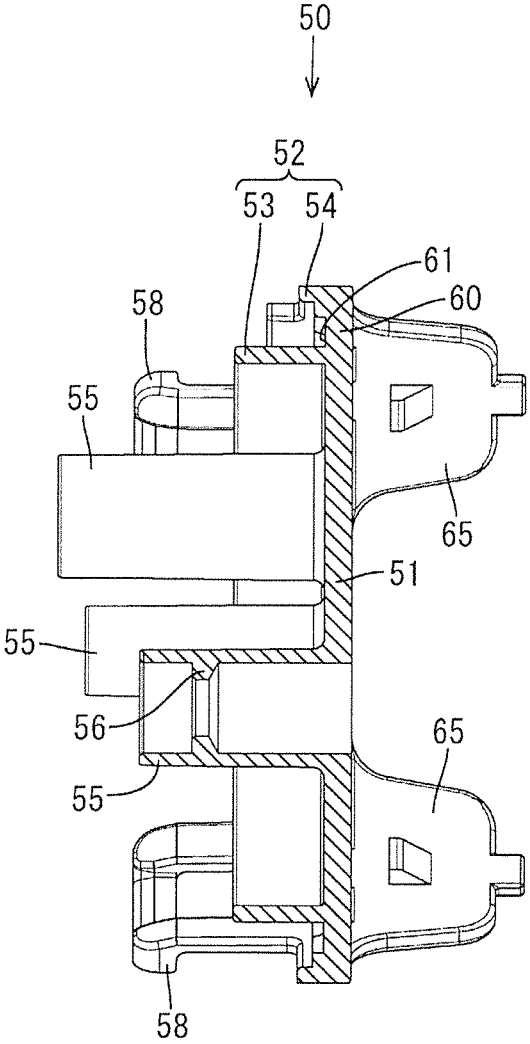
FIG. 11 is a section along d-d of FIG. 8.

As shown in FIG. 11, five locking sleeves 55 project forward on the front surface of the base plate 51. The locking sleeves 55 are at positions corresponding to the respective terminal accommodation chambers 30 in the terminal accommodating portion 25 of the housing 20, and fit tightly into the rear accommodation chambers in the terminal accommodation chambers 30.

As described later, when the retainer 50 is fit properly into the rear surface opening 40A of the peripheral wall 40, tips of the five locking sleeves 55 reach positions behind and at a predetermined distance from the intermediate walls 32 in the rear accommodation chambers and contact the terminal fittings stopped in front, as shown in FIG. 4.

Note that a part of the terminal fitting from the flange to the wire connecting portion and a part of the end of the wire pulled out rearward from the wire connecting portion are insertable into the locking sleeve 55.

The housing 20 is formed with a drainage structure to drain water splashed on a front surface side of the housing 20 to the outside of the housing 20, and the retainer 50 described above constitutes a part of the drainage structure.

The retainer 50 forms the drainage structure by being mounted to achieve a watertight closure of the rear opening 40A of the peripheral wall 40, and a rubber seal ring 70 is fit over the entire outer circumference of the inner tube 53 in the double tube portion 52 of the retainer 50.

Figure 7:
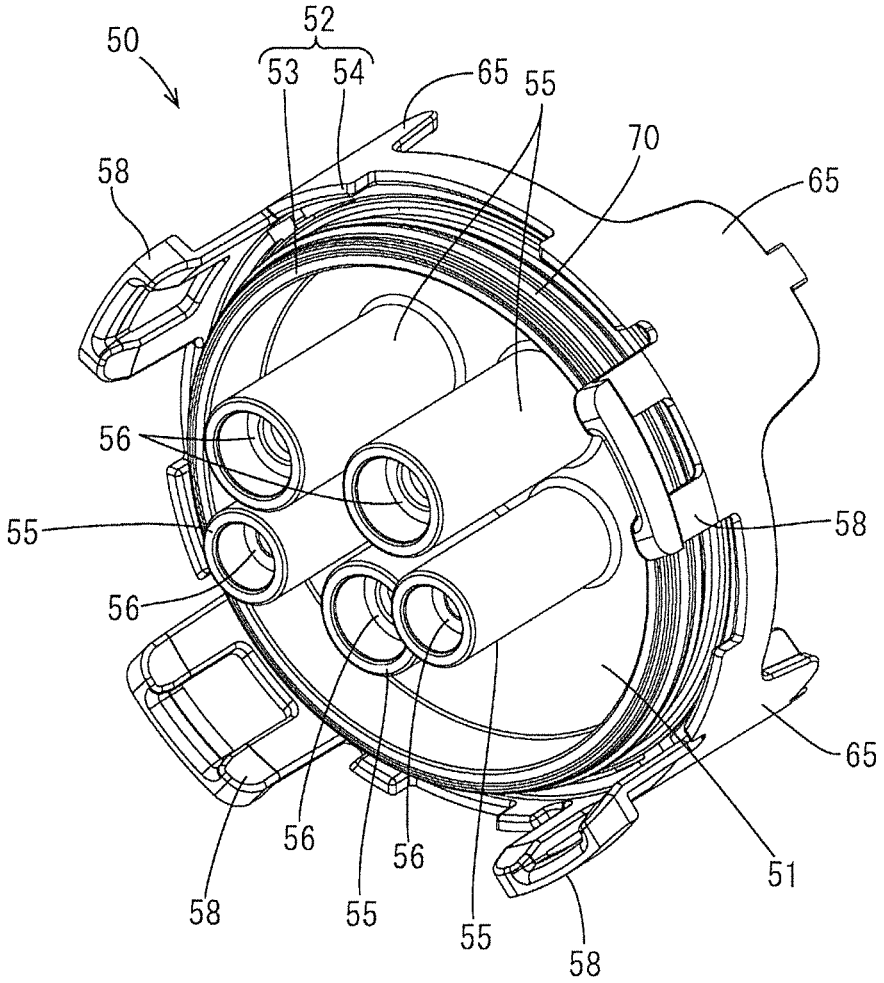
FIG. 7 is a perspective view of a retainer having a seal ring mounted thereon.
Figure 8:
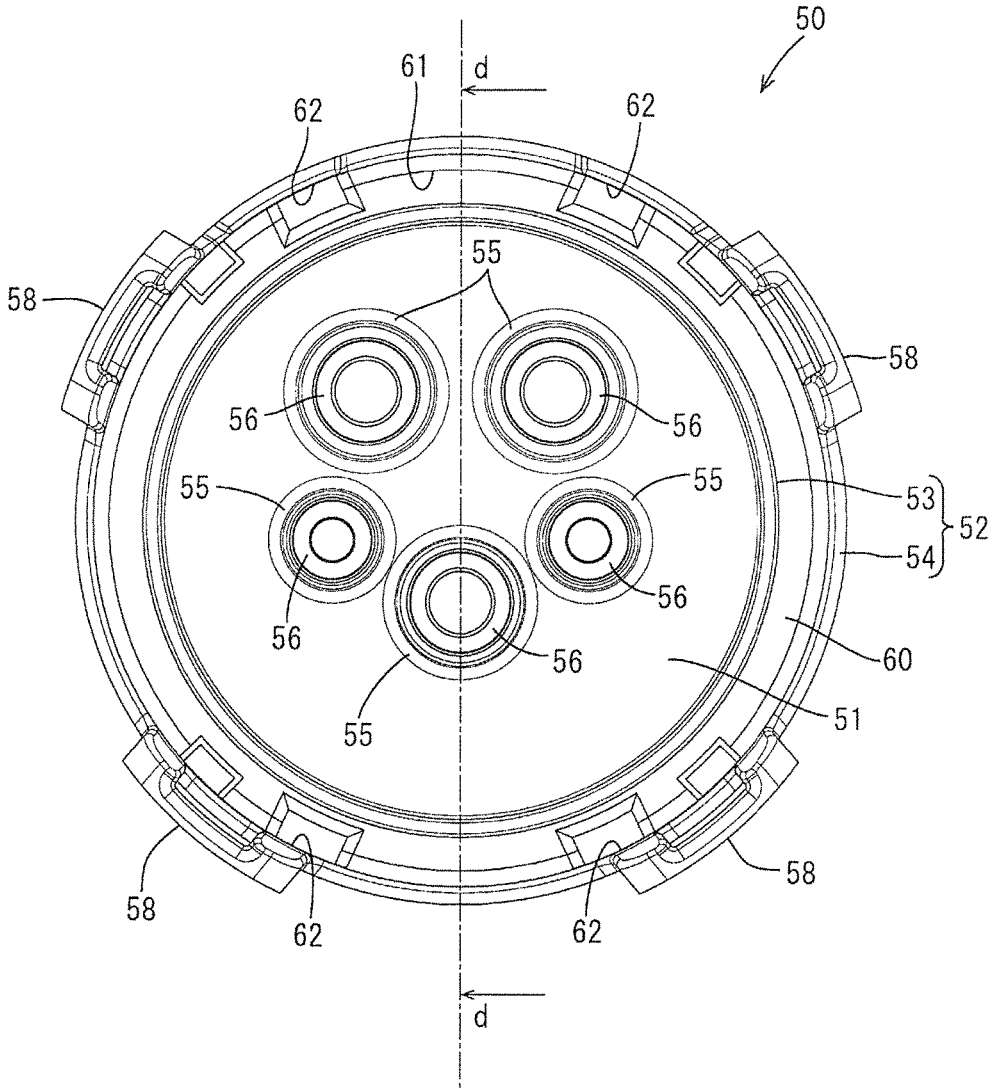
FIG. 8 is a front view of the retainer.
Figure 9:
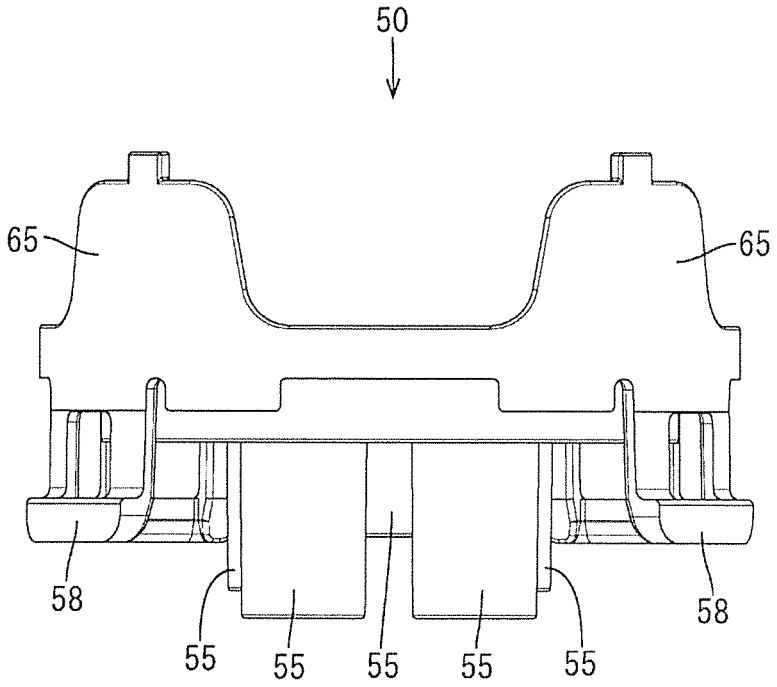
FIG. 9 is a plan view of the retainer.

Four lock pieces 58 are formed at predetermined angular intervals on the front edge of the outer tube 54 of the double tube portion 52, as shown in FIGS. 7 and 8, and lock protrusions (not shown) to be fit to the respective lock pieces 58 are formed on the outer peripheral surface of the peripheral wall 40.

Figure 18:
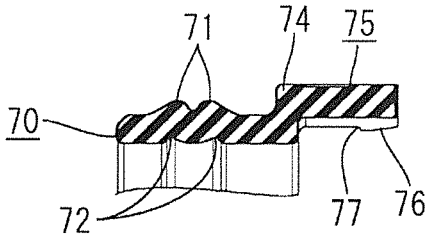
FIG. 18 is an enlarged section along h-h of FIG. 16.

As shown in FIGS. 14 to 17, the seal ring 70 has a width (length in an axial direction) comparable to a projecting length of the inner tube 53 and a thickness to fit tightly into a clearance between the outer peripheral surface of the inner tube 53 and the inner peripheral surface of the rear surface opening 40A of the peripheral wall 40. As shown in FIG. 18, two lips 71 extending over the entire circumference at a predetermined distance from each other in the axial direction. On the other hand, two cut grooves 72 are formed over the entire circumference at positions corresponding to the inner sides of the respective lips 71 on the inner peripheral surface of the seal ring 70. In this way, the thickness of the seal ring 70 is substantially constant in the axial direction.

Figure 14:
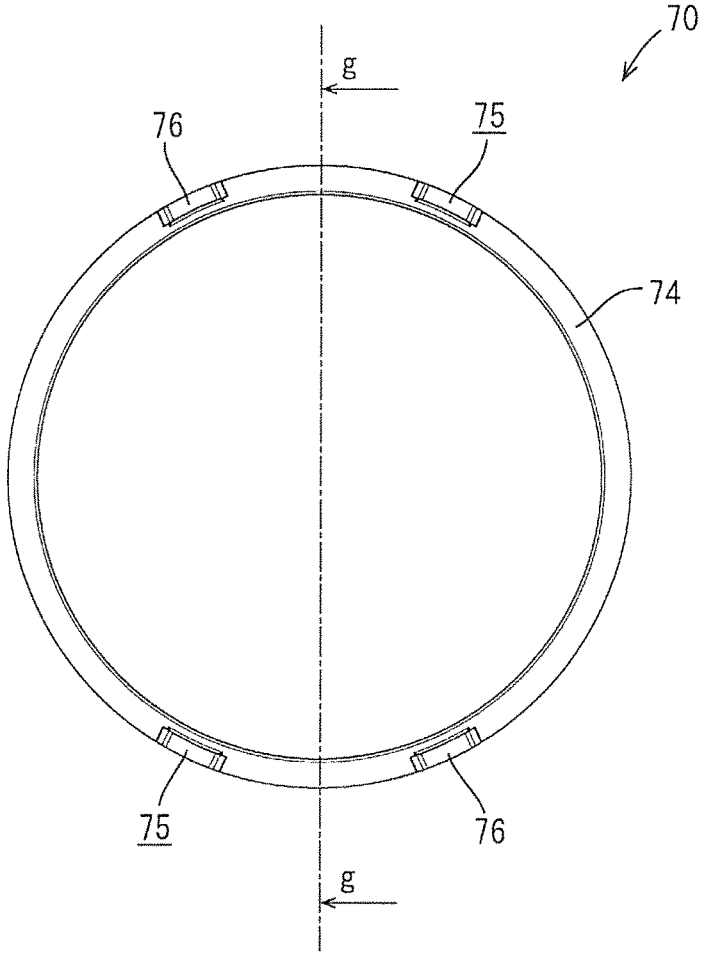
FIG. 14 is a back view of the seal ring.
Figure 15:
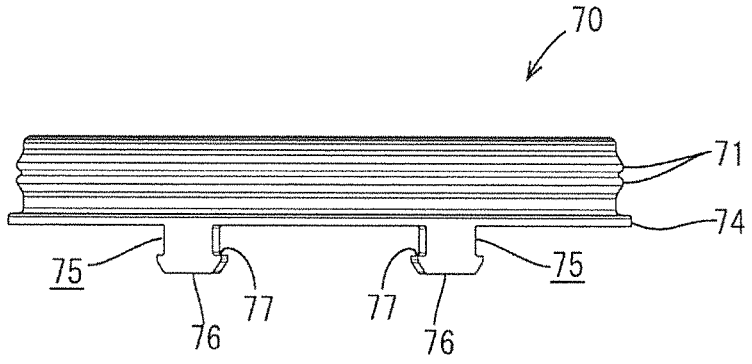
FIG. 15 is a plan view of the seal ring.
Figure 16:
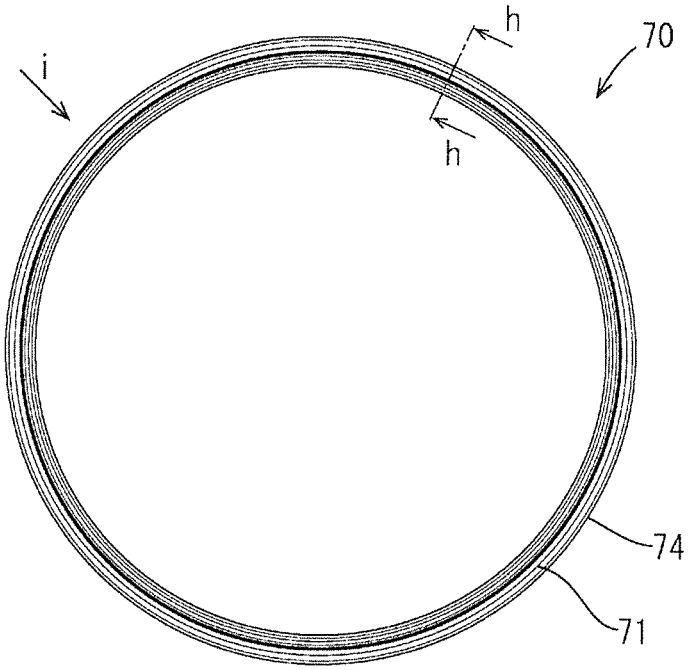
FIG. 16 is a front view of the seal ring.
Figure 17:
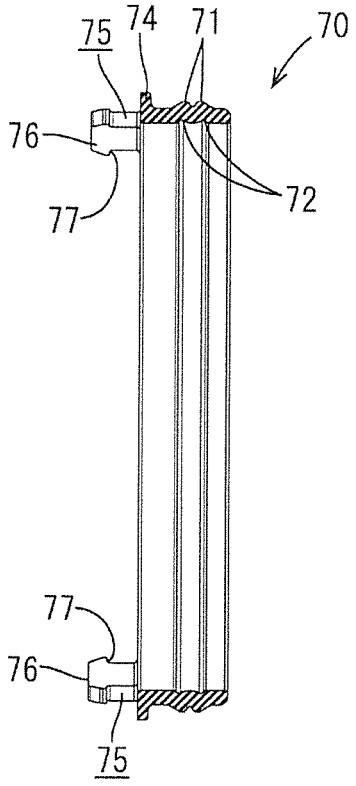
FIG. 17 is a section along g-g of FIG. 14.

A total of four retaining portions 75, two on each of upper and lower sides, project on the rear surface of the seal ring 70. Specifically, as shown in FIG. 18, a flange 74 having a short height stands over the entire circumference on the rear end of the seal ring 70 and the retaining portions 75 project from an outer peripheral part of this flange 74. The retaining portions 75 are formed at positions that are at 25° to left and right of a center line as shown in FIG. 14.

Figure 19:
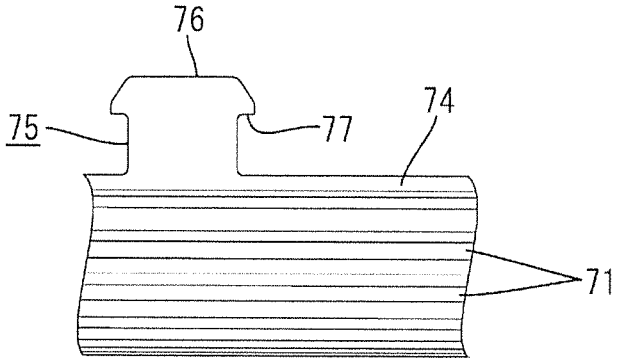
FIG. 19 is a partial enlarged plan view viewed in a direction i of FIG. 16.

The retaining portion 75 is a plate having substantially the same thickness as the seal ring 70 and a flat and substantially trapezoidal locking head 76 laterally protrudes from both left and right side edges of the retaining portion 75 on a tip part, as shown in FIG. 19. The locking head 76 has a rear locking edge 77 that is at a right angle to an axis line (center line) of the locking head 76. Further, the locking head 76 has a tapered shape gradually narrowed toward a tip.

Figure 12:
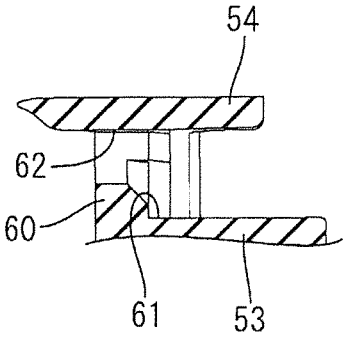
FIG. 12 is an enlarged section along e-e of FIG. 10.
Figure 13:
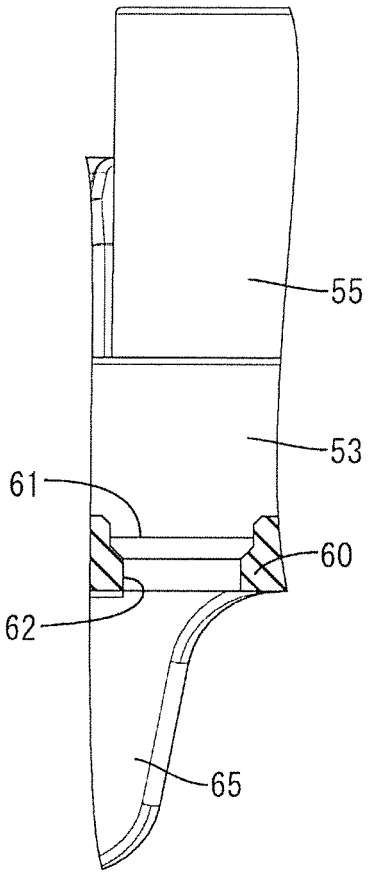
FIG. 13 is an enlarged section along f-f of FIG. 10.

The flange 74 of the seal ring 70 is fit in a fitting groove 61 that is formed over the entire circumference on the outer peripheral edge of the base plate 51 of the retainer 50, specifically in a part corresponding to a back wall 60 of the double tube portion 52, as shown in FIG. 12. Four locking holes 62 are formed on the back surface of the fitting groove 61 for receiving the respective retaining portions 75 (base end parts having a constant width).

Figure 6:
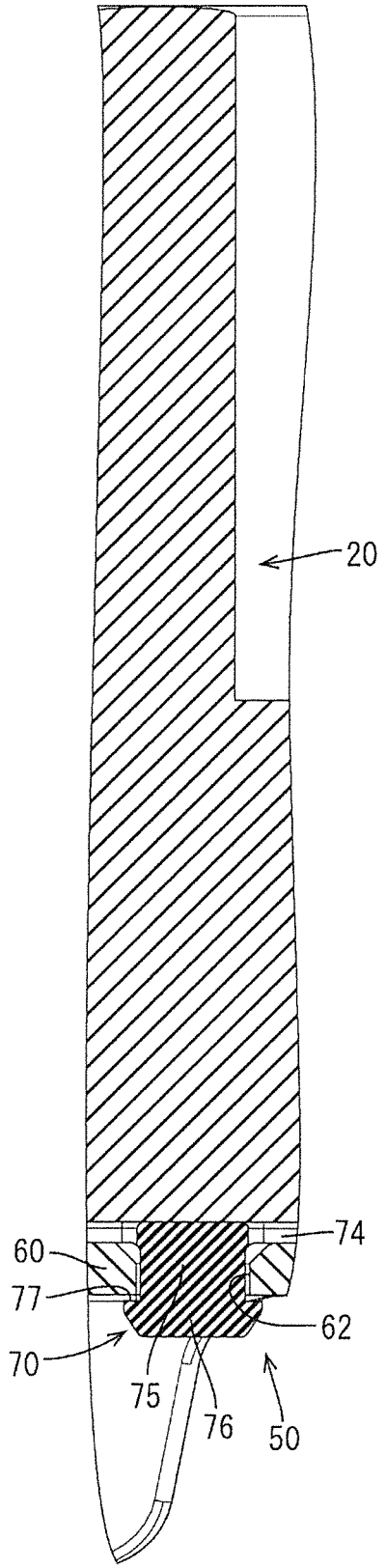
FIG. 6 is an enlarged section along c-c of FIG. 3.

The seal ring 70 is fit to the outer periphery of the inner tube 53 in the double tube portion 52 of the retainer 50 in a rotation posture in which the respective retaining portions 75 are aligned with the respective locking holes 62, and is pushed in sliding contact with the outer peripheral surface of the inner tube 53 halfway through while the locking heads 76 are compressed resiliently and inserted into the locking holes 62. The seal ring 70 is pushed to a proper position where the flange 74 is fit into the fitting groove 61 of the back wall 60 and is stopped. At this point, the locking heads 76 exit to back sides of the locking holes 62 and resiliently expand to an initial shape, and the rear edges 77 of the locking heads 76 are locked to left and right edges on the back sides of the locking holes 62, as shown in FIG. 6, to retain the seal ring 70.

Figure 10:
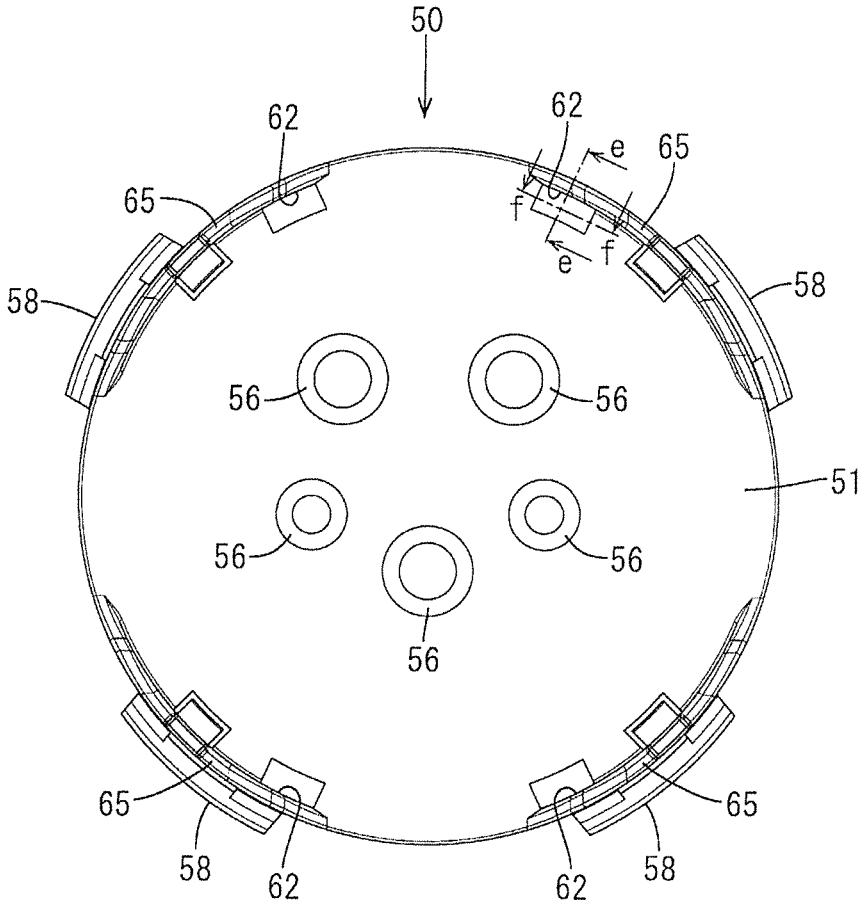
FIG. 10 is a back view of the retainer.

As shown in FIGS. 7 and 10, four arcuate mounting plates 65 project on the outer peripheral edge of the rear surface of the base plate 51 of the retainer 50 to mount a cover (not shown). Any of the locking holes 62 described above is formed at a position inward of the mounting plate 65, but particularly near a side edge of each mounting plate 65, as shown in FIG. 10. Thus, the locking holes 62 are easily confirmable even though the mounting plates 65 are provided.

Figure 5:
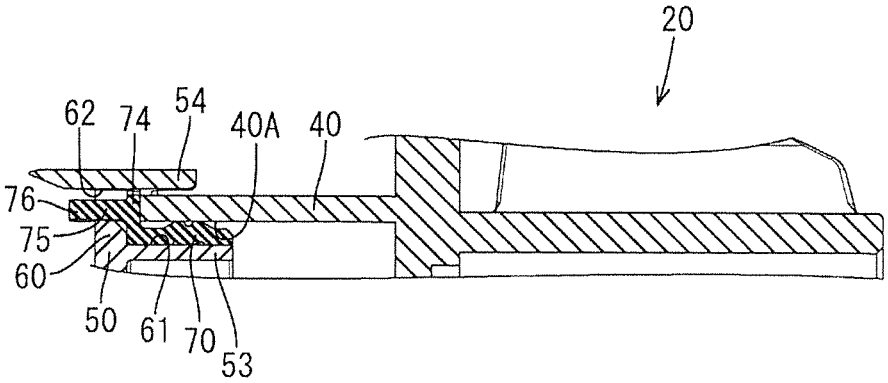
FIG. 5 is an enlarged section along b-b of FIG. 3.

The retainer 50 is positioned in a predetermined rotation posture by fitting the tip of each locking sleeve 55 into the rear end of the rear accommodation chamber of the corresponding terminal accommodation chamber 30. Thus, each locking sleeve 55 is inserted into the corresponding rear accommodation chamber from a state where the seal ring 70 is mounted as described above. Further, the rear end of the peripheral wall 40 is inserted and pushed into the double tube portion 52 while the seal ring 70 is compressed resiliently in a thickness direction between the outer peripheral surface of the inner tube 53 and the inner peripheral surface of the rear surface opening 40A of the peripheral wall 40. When the seal ring 70 is pushed to a position where the rear end of the peripheral wall 40 contacts the back wall 60 of the double tube portion 52 and the flange 74 of the seal ring 70, as shown in FIGS. 4 and 5, the respective lock pieces 58 are resiliently fit to the lock protrusions (not shown) (see FIG. 2), so that the retainer 50 is fit watertight in the rear surface opening 40A of the peripheral wall 40 and locked in this fitting state.

With the retainer 50 properly fit, the tips of the five locking sleeves 55 are located in the rear accommodation chambers and in contact with the terminal fittings.

In addition, a closed space is formed between the peripheral wall 40 and the terminal accommodating portion 25, the retainer 50.

Next, functions and effects of this embodiment are described.

The vehicle-side connector VC is assembled, for example, in the following procedure. The seal ring 70 is fit on the outer periphery of the inner tube 53 in the double tube portion 52 of the retainer 50 in the rotation posture in which the respective retaining portions 75 projecting on the rear surface are aligned with the respective locking holes 62 formed in the back wall 60 of the double tube portion 52. The seal ring 70 is fit on the outer periphery of the inner tube 53 and pushed in sliding contact with the outer peripheral surface of the inner tube 53 halfway through while resiliently compressing the locking heads 76 and inserting the locking heads 76 into the locking holes 62.

The locking heads 76 of the retaining portions 75 have a tapered shape and easily can be pushed into the locking holes 62. Further, the seal ring 70 slides on the outer peripheral surface of the inner tube 53 while receiving frictional resistance. However, the seal ring 70 is of substantially constant thickness in the axial direction. Thus, the seal ring 70 will not buckle during a siding movement, and the seal ring 70 is mounted relatively smoothly.

When the seal ring 70 is pushed to the proper position where the flange 74 thereof is fit into the fitting groove 61 of the back wall 60 and stopped, as shown in FIG. 5, the locking heads 76 exit to the back sides of the locking holes 62 and resiliently expand to have the initial shape, and the rear edges 77 of the locking head portions 76 are locked to the left and right edges on the back sides of the locking holes 62 as shown in FIG. 6, thereby retaining the seal ring 70.

After the seal ring 70 is mounted, it is discriminated that the seal ring 70 is properly retained at the proper position by visually confirming that the locking heads 76 of the four retaining portions 75 have passed to the back sides of the corresponding locking holes 62. If there is any locking head 76 of the retaining portion 75 that has not exited to the back side of the locking hole 62, a specific position of the seal ring 70 is pushed until this locking head 76 exits to the back side.

The retainer 50 is moved forward after the five terminal fittings are accommodated into the corresponding terminal accommodation chambers 30 while being stopped in front. Thereafter, the retainer 50 is positioned to align the respective locking sleeves 55 with the rear accommodation chambers of the corresponding terminal accommodation chambers 30, the respective locking sleeves 55 are inserted into the rear accommodation chambers, and the rear end part of the peripheral wall 40 is inserted and pushed into the double tube portion 52 while the seal ring 70 is compressed resiliently in the thickness direction.

Figure 2:
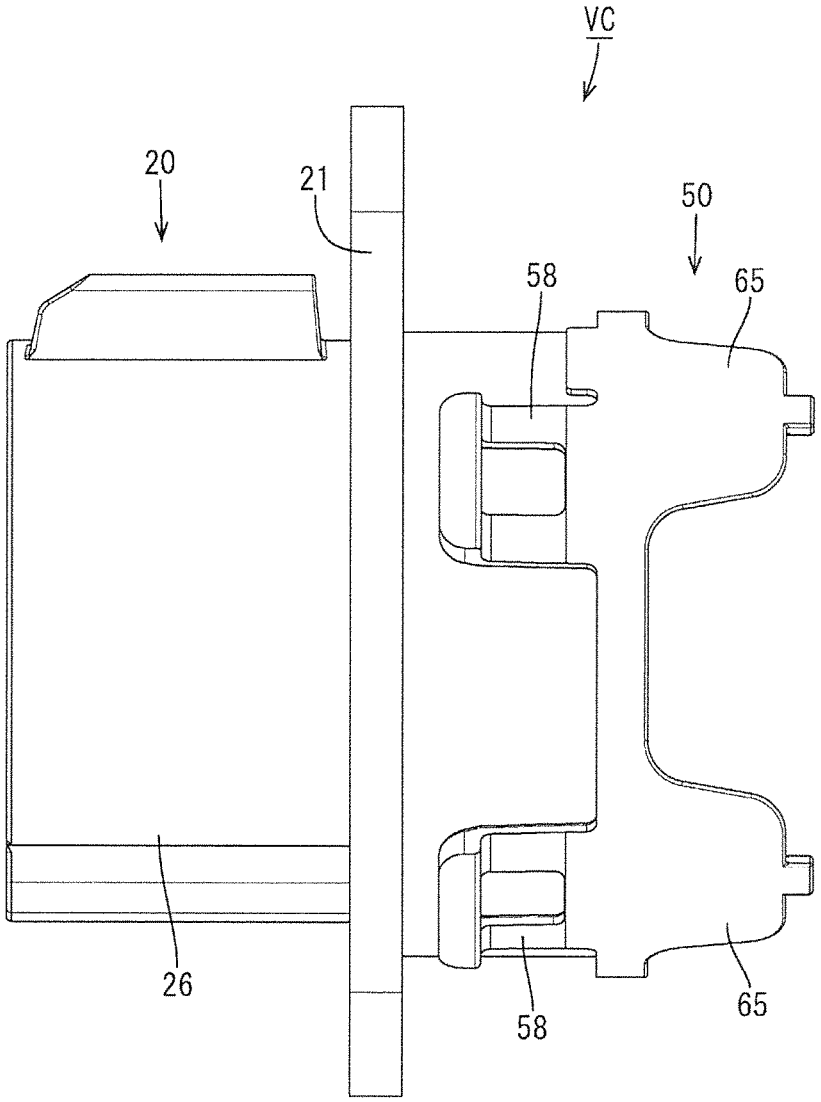
FIG. 2 is a side view of the vehicle-side connector.
Figure 3:
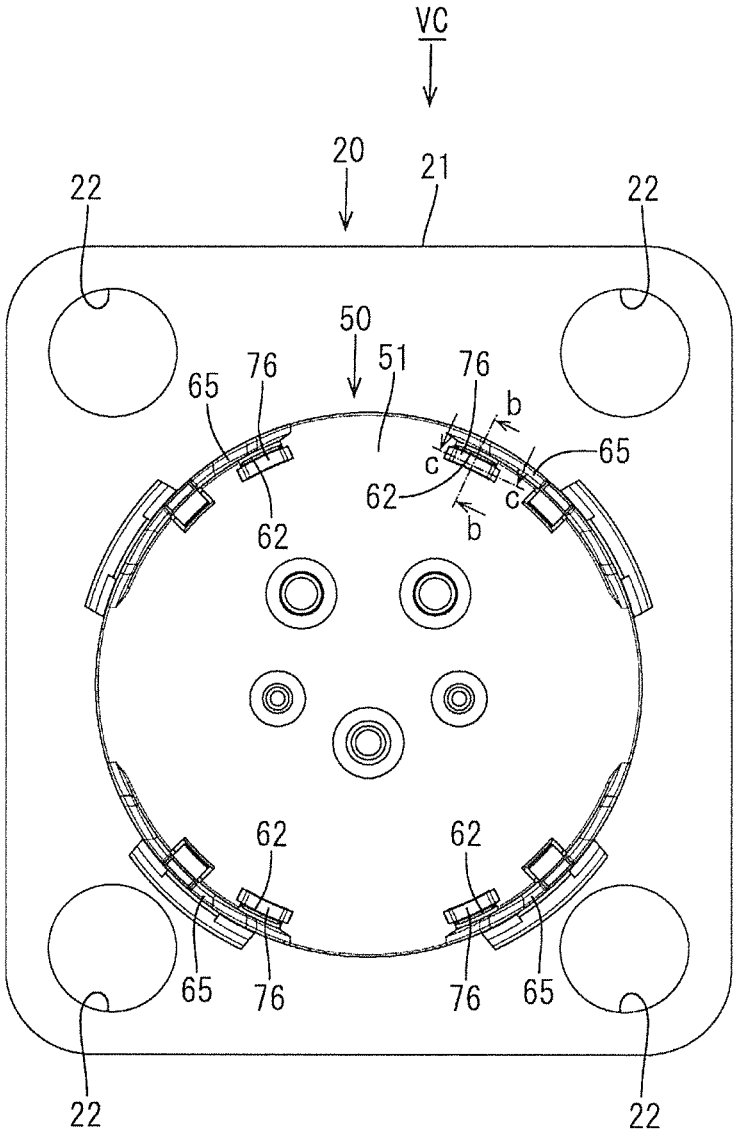
FIG. 3 is a back view of the vehicle-side connector.

When the retainer 50 is pushed to a proper position where the rear end of the peripheral wall 40 contacts the back wall 60 of the double tube portion 52, as shown in FIGS. 4 and 5, the lock pieces 58 provided on the retainer 50 are fit resiliently to the unillustrated lock protrusions, as shown in FIG. 2. In this way, the retainer 50 is fit watertight in the rear surface opening 40A of the peripheral wall 40 and is locked in this fitting state.

With the retainer 50 properly fit in this way, the tips of the five locking sleeves 55 are inserted to positions behind the intermediate walls 32 of the corresponding terminal accommodation chambers 30 and contact the terminal fittings stopped, as shown in FIG. 4. Thus, the terminal fittings are retained so as not to come off rearward.

Further, the closed space is formed between the peripheral wall 40 and the terminal accommodating portion 25, the retainer 50 by watertightly fitting the retainer 50 into the rear surface opening 40A of the peripheral wall 40 of the housing 20.

Finally, the five wires pulled out from the rear ends of the respective locking sleeves 55 of the retainer 50 are bundled after being bent down, and caused to extend down while being accommodated into the unillustrated cover to complete the assembling of the vehicle-side connector VC.

The vehicle-side connector VC assembled as described above is inserted into a mounting hole that is open in the panel from an inner surface side and is fixed to the panel by bolting four corners of the mounting plate 21. At this time, the vehicle-side connector VC is mounted in a rearward inclined posture in which an upper end is inclined slightly rearward.

On the other hand, on a rear surface side of the vehicle-side connector VC, the wires bundled and extending down are passed through a corrugated tube or a boot for waterproofing and then connected to the battery mounted in the vehicle.

During a charging operation, a lid disposed on a front of the housing 20 (terminal accommodating portion 25) of the vehicle-side connector VC is opened, a charging connector connected to an external power supply is fit to the housing 20 (terminal accommodating portion 25) of the vehicle-side connector V to charge the battery.

As described above, in this embodiment, in a part where the seal ring 70 is fit on the outer peripheral surface of the inner tube 53 in the double tube portion 52 of the retainer 50, each of the four retaining portions 75 include the locking head 76 on the tip are formed to project on the rear surface of the seal ring 70, whereas the locking holes 62 into which the retaining portions 75 are insertable are provided in the back wall 60 of the double tube portion 52 and the locking head portions 76 are locked to the hole edge parts of the locking holes 62 from behind. In short, a function of retaining the seal ring 70 is achieved by this structure.

Thus, a positional deviation of the seal ring 70 from a proper mounting position is prevented when the retainer 50 is transported to a connector assembling site or the like, and a reliable sealing function can be obtained when the retainer 50 is fit into the rear surface opening 40A of the peripheral wall 40 of the housing 20.

Further, proper mounting of the seal ring 70 is assured by visually confirming that the locking heads 76 of the retaining portions 75 on the seal ring 70 have passed to the back sides of the locking holes 62 and, consequently, it is also ensured that a proper sealing function is exhibited when the retainer 50 is mounted. Thus, a large-scale process for inspecting the presence or absence of leakage need not be performed, and a connector assembling process can be simplified.

The rear edge of the locking head desirably is at a right angle to an axis line to enhance a retaining force in the case of adopting a structure for retention by inserting the retaining portion with the locking head into the locking hole. However, the locking head needs to be forcibly removed from a hole of a mold, and there is a limit in making an angle of the rear edge of the locking head closer to a right angle.

Accordingly, in this embodiment, the retaining portion 75 is plate-like and shaped such that the locking head 76 is provided to protrude laterally from both side edges of the retaining portion 75. Thus, even if the rear edge 77 of the locking head 76 is formed to be at a right angle to the axis line, the retaining portion 75 can be removed forcibly by suppressing an area of engagement with an edge of the mold hole. As a result, a high retaining force by the retaining portion 75 can be obtained.

The seal ring 70 of this embodiment is formed with the two lips 71 on the outer peripheral surface to enhance adhesion, whereas the two cut grooves 72 are formed over the entire circumference at the positions corresponding to the inner sides of the respective lips 71 on the inner peripheral surface. In this way, the thickness of the seal ring 70 is substantially constant in the axial direction.

The seal ring 70 is mounted on the outer peripheral surface of the inner tube 53 in the double tube portion 52 of the retainer 50 while receiving frictional resistance. Since the thickness of the seal ring 70 is substantially constant as described above, the seal ring 70 will not buckle during mounting and, consequently, the seal ring 70 can be mounted more smoothly.

Further, since the locking head 76 of the retaining portion 75 on the retainer 50 is tapered, the locking head 76 of the retaining portion 75 is pushed easily into the locking hole 62. This is also effective in smoothly mounting the seal ring 70.

The invention is not limited to the above described and illustrated embodiment. For example, the following various modes also are included.

The number and arrangement of the retaining portions 75 provided on the rear surface of the seal ring are arbitrary without being limited to those illustrated in the above embodiment but, preferably, a plurality of retaining portions are disposed in a well-balanced manner over the entire circumference.

Although the retaining portion 75 is plate-like in the above embodiment, the retaining portion may have another shape such as a round or rectangular bar shape.

The number of the lips 71 formed on the outer peripheral surface of the seal ring is not limited to two as illustrated in the above embodiment. One, three or more lips may be provided. In that case, as many cut grooves 72 as the lips 71 are preferably formed in the inner peripheral surface of the seal ring.

On the other hand, the cut grooves 72 in the inner peripheral surface of the seal ring are not always necessary. The cut grooves 72 may not be formed or inner peripheral lip(s) may be provided irrespective of the positions of the lips 71 on the outer peripheral surface. Such seal rings also are included in the scope.

The assembling procedure of the vehicle-side connector VC illustrated in the above embodiment is merely an example and can be changed as appropriate, for example, by shifting a mounting timing of the seal ring 70 on the retainer 50.

Rear end openings of the locking sleeves 55 provided on the retainer may be sealed by individual rubber plugs if necessary.

Although the wires pulled out to the rear surface of the housing 20 are bent at a right angle in the above embodiment, the wires may extend rearward along the axial direction.

The technique disclosed in this specification is not limitedly applied to vehicle-side connectors and can be widely applied to waterproof structures of connectors in general formed such that a retainer for retaining terminal fittings is fit into a rear surface opening of a housing accommodating the terminal fittings.

LIST OF REFERENCE SIGNS

VC . . . vehicle-side connector (connector)
20 . . . inlet housing (housing)
30 . . . terminal accommodation chamber
40 . . . peripheral wall
40A . . . rear surface opening
50 . . . retainer
53 . . . inner tube (fitting tube)
55 . . . locking sleeve
60 . . . back wall (peripheral edge part of retainer 50)
62 . . . locking hole
70 . . . seal ring
71 . . . lip
72 . . . cut groove
75 . . . retaining portion
76 . . . locking head
77 . . . rear edge (of locking head 76)

The invention claimed is:

1. A connector, comprising:

a housing provided with a terminal accommodation chamber;

a retainer to be mounted while covering a rear surface opening of the housing;

a fitting tube provided on a front surface of the retainer and configured to be fit into the rear surface opening of the housing with a clearance; and a seal ring to be mounted on an outer peripheral surface of the fitting tube and resiliently compressed between the outer peripheral surface of the fitting tube and an inner peripheral surface of the rear surface opening;

wherein:

a retaining portion having a locking head on a tip is formed to project on a rear surface of the seal ring;

a locking hole is provided in a peripheral edge part of the retainer, the retaining portion being passable through the locking hole, and the locking head is locked to an edge of the locking hole from behind; and the locking head is plate-like and protrudes laterally from both side edges of the retaining portion.

2. The connector of claim 1, wherein the retaining portion is plate-like and the locking head is formed to protrude laterally from both side edges of the retaining portion.

3. The connector of claim 2, wherein:

a lip to be held in close contact with the inner peripheral surface of the rear surface opening of the housing is formed over an entire circumference on an outer peripheral surface of the seal ring; and a cut groove is formed over the entire circumference at a position corresponding to an inner side of the lip on an inner peripheral surface of the seal ring.

4. The connector of claim 3, wherein the locking head of the retaining portion has a tapered shape.

5. The connector of claim 1, wherein:

a lip to be held in close contact with the inner peripheral surface of the rear surface opening of the housing is formed over an entire circumference on an outer peripheral surface of the seal ring; and a cut groove is formed over the entire circumference at a position corresponding to an inner side of the lip on an inner peripheral surface of the seal ring.

6. The connector of claim 1, wherein the locking head of the retaining portion has a tapered shape.

* * * * *